US005926172A

United States Patent [19]

Hanley

[11] Patent Number: 5,926,172

[45] Date of Patent: Jul. 20, 1999

[54] VIDEO DATA TRANSMISSION AND DISPLAY SYSTEM AND ASSOCIATED METHODS FOR ENCODING/DECODING SYNCHRONIZATION INFORMATION AND VIDEO DATA

[75] Inventor: William Hanley, Cedar Creek, Tex.

[73] Assignee: INT Labs, Inc., Austin, Tex.

[21] Appl. No.: 08/935,968

[22] Filed: Sep. 23, 1997

Related U.S. Application Data

[60] Provisional application No. 60/056,945, Aug. 25, 1997.

[51] Int. Cl.[6] ..... G09G 5/00

[52] U.S. Cl. ..... 345/210; 345/212; 345/213; 345/214

[58] Field of Search ..... 345/10, 97, 98, 345/99, 100, 210, 211, 212, 213, 214

[56] References Cited

U.S. PATENT DOCUMENTS

| | | | |
|---|---|---|---|
| 4,012,592 | 3/1977 | Ricard | 345/213 |
| 5,177,475 | 1/1993 | Stephany et al. | 345/97 |
| 5,389,952 | 2/1995 | Kikinis | 345/212 |
| 5,579,029 | 11/1996 | Arai et al. | 345/213 |
| 5,616,988 | 4/1997 | Kim | 345/211 |

*Primary Examiner*—Vijay Shankar
*Attorney, Agent, or Firm*—Haynes and Boone, LLP

[57] ABSTRACT

Video data transmission and display system configured for transmitting three video data signals and two synchronization signals over three lines while preserving polarity information for the synchronization signals. The system includes a video encoder which combines the R video signal and the HSYNC synchronization signal into a first video/synchronization composite signal and combines the B video signal and the VSYNC synchronization signal into a second video/synchronization composite signals. The two video/synchronization composite signals are transmitted, together with the G video signal, over respective ones of three transmission lines to a video monitor. The video monitor includes a video decoder which separates the original video and synchronization signals from each of the video/synchronization composite signals.

33 Claims, 4 Drawing Sheets

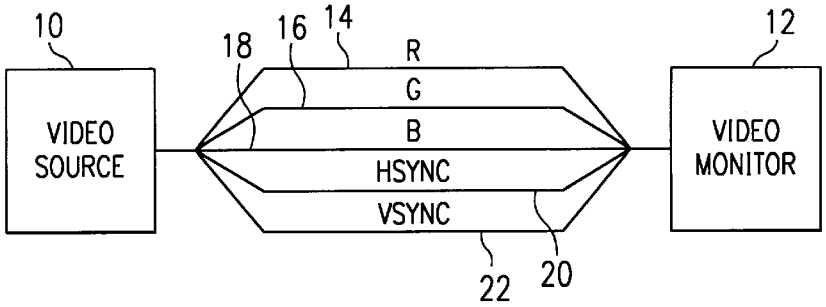
*Fig. 1A*
*(PRIOR ART)*
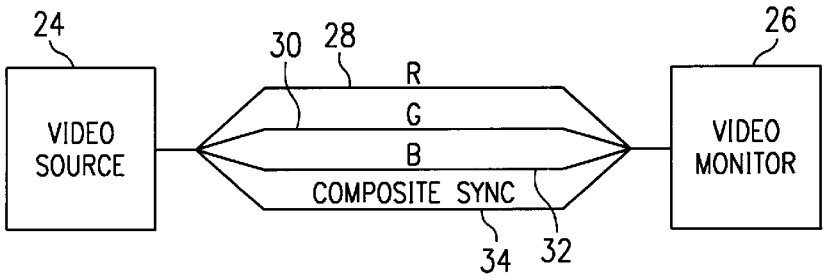
*Fig. 1B*
*(PRIOR ART)*
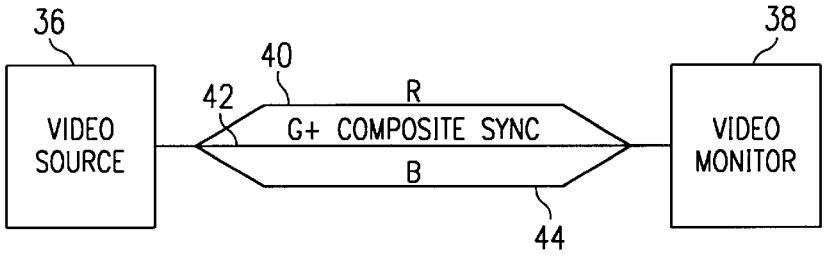
*Fig. 1C*
*(PRIOR ART)*
*Fig. 2*
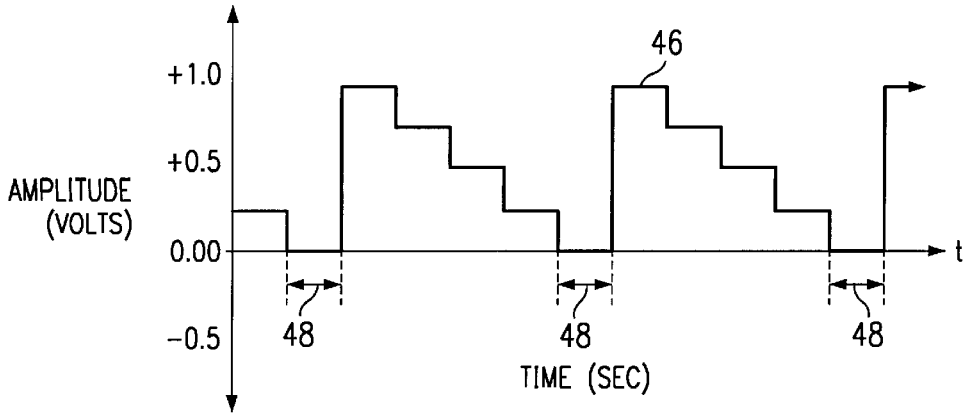

VIDEO DATA TRANSMISSION AND DISPLAY SYSTEM AND ASSOCIATED METHODS FOR ENCODING/DECODING SYNCHRONIZATION INFORMATION AND VIDEO DATA

CROSS-REFERENCE TO RELATED PROVISIONAL APPLICATION

This application claims the benefit of U.S. Provisional Patent Application Ser. No. 60/056,945 (Atty. Docket No. 10393.28), filed on Aug. 25, 1997.

TECHNICAL FIELD

The invention relates generally to a video data transmission and display system and, more particularly, to a video data transmission and display system which incorporates an encoder for combining selected video data and synchronization information into a synchronization polarity-insensitive composite signal and an associated decoder for separating the video data and the synchronization information from the composite signal.

BACKGROUND OF THE INVENTION

Video displays such as computer monitors generate images using video signals received from a computer system, for example, a personal computer (or "PC"), or other source of video data. For many such displays, images are produced using data received from three video signals—red, green and blue—collectively referred to as RGB video data signals. In addition to the aforementioned video data signals, most video displays also receive two other signals—a horizontal synchronization (or "sync") signal and a vertical sync signal. The horizontal sync signal is used to synchronize the monitor to the video signal source. Specifically, the video signal source transmits a serial data stream to the video monitor which begins to scan from left to right across the screen using an electron beam. At the end of a line, a horizontal sync pulse indicates the end of the line. Upon receiving the horizontal sync pulse, the monitor will reposition the electron beam back to the left border of the screen and begin scanning to the right again. The vertical sync pulse, on the other hand, indicates to the video monitor to begin a new screen by repositioning the electron beam back to the top left corner of the screen.

Currently, there are three techniques by which these three video signals and two sync signals are transmitted from a video source to a video monitor. The first of these techniques may be seen by reference to FIG. 1*a*. Here, a video source 10 and a video monitor 12 are coupled together by first, second, third, fourth and fifth lines 14, 16, 18, 20 and 22, each of which respectively carries one of the R, G, B, horizontal sync (or "HSYNC") and vertical sync (or "VSYNC") signals from the video source 10 to the video monitor 12. While adequate for use, this configuration is considered disadvantageous in that it requires five shielded cables, together with associated connection circuitry, in order to convey the requisite signals. As a result, therefore, this configuration would be both more expensive to manufacture and less convenient for use in video applications where space is at a premium.

For these reasons, various solutions by which the five video signals are transmitted from the video source to a video monitor using a lesser number of cables have been proposed. A four line solution may be seen by reference to FIG. 1*b*. Here, a video source 24 is coupled to a video monitor 26 by first, second, third and fourth cables 28, 30, 32 and 34. As before, the first, second and third cables 28, 30 and 32 are used to transmit respective ones of the R, G and B video data signals. Here, however, the HSYNC and VSYNC signals are combined into a composite sync signal for transmission over a composite sync cable, for example, the fourth cable 34. While the inability of video monitors to distinguish between HSYNC and VSYNC pulses was initially considered to be an obstacle to this approach, this problem was solved relatively easily by varying the comparative duration of the HSYNC and VSYNC pulses. Thus, the video monitor 26 would distinguish between the HSYNC and VSYNC pulses based upon comparative duration, i.e., pulses having a duration in excess of a pre-selected value are classified as VSYNC pulses while pulses having a duration below the pre-selected value are classified as HSYNC pulses. While this configuration successfully reduced the number of required connections between the video source 24 and the video monitor 26 from 5 to 4 and achieved, therefore, considerable savings in both cost and consumption of space, it should be readily appreciated that further savings are possible if the number of required connections could be reduced still further.

A three line configuration is illustrated in FIG. 1*c*. As may now be seen, a video source 36 is coupled to a video monitor 38 by only first, second and third lines 40, 42 and 44. Similar to the systems disclosed in FIGS. 1*a–b*, the first and third cables 40 and 44 carry the R and B video data signals. Here, however, the second cable 42 carries both the G video data signal and the composite sync signal. Combining video data and sync signals on a single line is possible because of the characteristic of video data signals to periodically blank. Blanking intervals are those periods during which a video signal is inactive. For example, a video data signal blanks whenever the electron beam is positioned outside the active display area of the monitor, i.e., is positioned along the border or porch of the screen, or while the electron beam is repositioning itself for scanning a next line. or next screen.

While the three cable solution would appear to be the most desirable of the various configurations disclosed in FIGS. 1*a–c*, certain considerations have limited the use thereof. Specifically, to combine video and synchronization data into a single signal, synchronization data is inserted into the blanking intervals of the G video signal prior to transmission of the video/composite sync composite signal over the second line 42. Upon receipt by the video monitor 38, the synchronization data is stripped off before generation of an image thereby. So that the video monitor 38 can readily distinguish between the video data component and the sync component of the received video/synchronization composite signal, the video monitor 38 is instructed that the data component of the video/synchronization composite signal will always be positive while the sync component will always be negative. Such an instruction, however, presumes that all composite sync signals will be polarity insensitive, i.e., will always have the same polarity. If different sync signals had different polarities, important synchronization information could be lost when combining and/or separating the video and sync signals.

Unfortunately, this presumption is not always necessarily true. The polarity of synch pulses for RGB-type monitors is determined by the software drivers used in the computer's video boards. Thus, different computer systems may use sync signals having different polarities. In some platforms, for example, MS-DOS, HSYNC pulses are negative. In other platforms, for example, Windows, HSYNC pulses are positive. Thus, to switch between these two platforms, monitors, which are generally considered to be non-platform specific, must be sufficiently sophisticated to distinguish between the different types of sync signals and adjust their operations appropriately. If, however, the display system is configured as illustrated in FIG. 1*c* such that sync information is presumed negative and combined with a video signal prior to transmission from the video source 36 to the video monitor 38, the video monitor 38 would be unable to distinguish whether the sync signal, once separated from the video signal, should be positive or negative. For this reason, the three line solution illustrated in FIG. 1*c* is used infrequently. Instead, the four line (R, G, B, composite sync) solution illustrated in FIG. 1*b*, while requiring the use of additional cables and associated connection circuitry, is more commonly used since, by maintaining a dedicated sync line, the polarity information for synchronization signals is preserved.

SUMMARY OF THE INVENTION

The present invention provides a video data transmission and display system which enables the transmission of three data signals and two synchronization signals over three lines while simultaneously preserving polarity information for the synchronization signals without need for complicated polarity detection and encoding techniques. By doing so, both the cost and the complexity of a video data transmission and display system may be substantially reduced.

In accordance with the present invention, a video encoder respectively combines first and second video data signals such as the R and B signals with first and second synchronization signals such as the HSYNC and VSYNC signals to produce first and second video/synchronization composite signals, both of which are polarity insensitive. The two video/synchronization composite signals are transmitted, together with a third video signal such as the G signal, to a video monitor via first, second and third lines, respectively. The video monitor includes a video decoder which separates the original video and synchronization signals from each of the video/synchronization composite signals.

The video encoder includes a first combine circuit which produces the first video/synchronization composite signal from the first video and first synchronization signals and a second combine circuit which produces the second video/synchronization composite signal from the second video and second synchronization signals. Each combine circuit includes an operational amplifier having an amplifying input coupled to a video data signal and a inverting input coupled to a synchronization signal. By coupling the operational amplifier in this manner, the output of the combine circuit is a video/synchronization composite signal comprised of a combination of the inversion of the synchronization signal and the video signal. By adding the video signal to an inversion of the synchronization signal, the video and synchronization components of the resultant video/synchronization composite signal may be readily discerned, regardless of polarity, as the inversion of a negative-going synchronization signal causes a below-axis shift of the video component of the video/synchronization composite signal.

The video decoder includes a first separator circuit which generates the first video signal and the first synchronization signal from the first video/synchronization composite signal and a second separator circuit which generates the second video signal and the second synchronization signal from the second video/synchronization composite signal. Each separator circuit generates the video signal by combining the video/synchronization composite signal and the synchronization signal. In turn, the synchronization signal is produced by a comparator having, as inputs thereto, the video/synchronization composite signal and a negative reference voltage signal having a magnitude approximately equal to the difference between a peak pulse level for the synchronization signal and a peak pulse level from the video signal.

BRIEF DESCRIPTION OF THE DRAWINGS

FIG. 1*a* is a block diagram of a conventional 5-line solution to interconnecting a video source and a video monitor.

FIG. 1*b* is a block diagram of a conventional 4-line solution to interconnecting a video source and a video monitor;

FIG. 1*c* is a block diagram of a conventional 3-line solution to interconnecting a video source and a video monitor.

FIG. 2 is a graphical illustration of a typical video signal.

DETAILED DESCRIPTION OF THE PREFERRED EMBODIMENT

Figure 3:
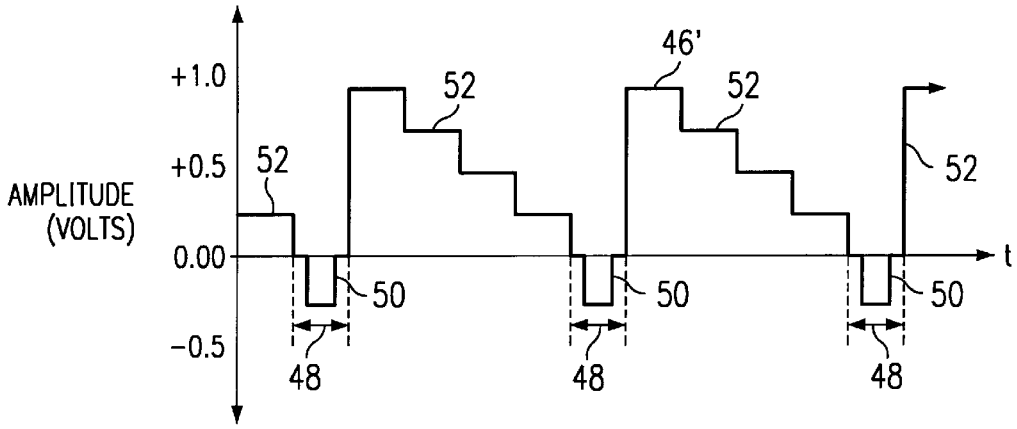
FIG. 3 is a graphical illustration of the video signal of FIG. 2 combined with a negative-going sync pulse.

Referring momentarily to FIGS. 2–3, certain characteristics of a video data signal, whether R, G or B, which permit a sync signal to be combined therewith in a video/synchronization composite signal in accordance with the teachings of the present invention shall now be described in greater detail. As may be seen in FIG. 2, a video signal 46 has an amplitude which varies between selected analog levels as a function of time. Each level corresponds to the intensity of a picture element (or "PEL") of a particular color to be generated while the time at which the signal is generated at that level corresponds to a location, within the display, where the PEL having the indicated color and intensity is to be generated. As every video display is comprised of a discrete number of PELs, the video signal 46 changes level each time it moves from PEL to PEL. As previously set forth, the video signal 46 periodically includes blanking periods 48, during which the amplitude of the video signal 46 drops to zero, which provide time for the electron beam to reposition itself for scanning a next line or next screen. As both the HSYNC and VSYNC signals always occur during the blanking periods 48, it is possible, when producing a video/synchronization composite signal, to place synchronization information in the blanking periods 48 of the video signal 46. An exemplary video/synchronization composite signal 46' is shown in FIG. 3. As may now be seen, the video/synchronization composite signal 46' now includes a series of sync data components 50, all of which occur during the blanking periods 48 which separates video data components 52. To ensure that the sync data components 50 are not confused with the video data components 52, all sync data components 50 are negative while all video data components 52 are positive.

Figure 4:
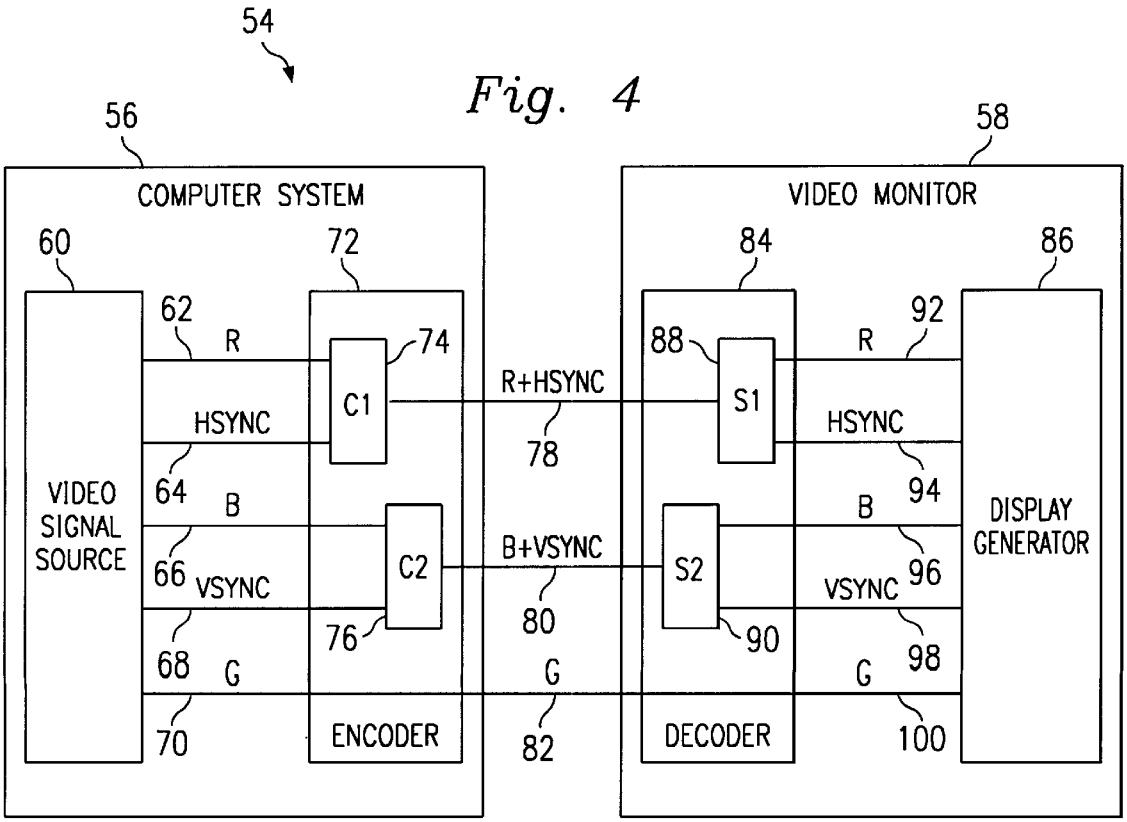
FIG. 4 is a simplified block diagram of a video display system constructed in accordance with the teachings of the present invention.

Referring now to FIG. 4, a video display system 54 constructed in accordance with the teachings of the present invention will now be described in greater detail. Specifically, the invention is directed to a video display system 54 which, depending on certain characteristic of an original synchronization signal, modifies one or both of the video and synchronization components of a video/synchronization composite signal produced from an original video signal and the original synchronization signal. The video display system 54 is comprised of a computer system 56 coupled to a video monitor 58. The computer system 56 provides, as an output thereof, video data to the video monitor 58 where an image is generated using the video data provided thereto. Of course, the designation of the computer system 54 as the source of the video data is purely by way of example and that other sources of video data such as laser disc or digital video disc (or "DVD") players are equally suitable for use as the source of video data.

The computer system 56 includes a video source 60 which generates three video signals, R, B and G, and two synchronization signals HSYNC and VSYNC. The R B and G video signals are respectively output on first, third and fifth output lines 62, 66 and 70 while the HSYNC and VSYNC synchronization signals are output on the second and fourth output lines 64 and 68. Coupled to the output lines 62–70 is an video encoder 72 which converts the five input signals into three output signals. More specifically, the video encoder 72 converts the R video signal and the HSYNC synchronization signal into a first video/synchronization composite signal R+HSYNC, converts the B video signal and the VSYNC synchronization signal into a second video/synchronization composite signal B+VSYNC and passes the G video signal without modification. It is specifically contemplated that, in alternate embodiments of the invention, any of the synchronization signals may be combined with any of the video signals to produce a video/synchronization composite signal. It is further contemplated that, in still other alternate embodiments of the invention, others of the video signals may be selected to pass through the video encoder 72 without modification. It is generally recommended, however, that the G signal remain uncombined since, in some video display systems, the G signal is used to carry other information such as a combined synchronization signal. It should be noted that the computer system 56 has been greatly simplified for ease of illustration and that various other types of electronic devices are typically incorporated therein. It should also be noted that it is specifically contemplated that the video signal source 60 may be variously configured to encompass devices such as video signal generators and/or devices which extract video signals from a storage medium, for example, a compact disc (or "CD").

The encoder 72 is comprised of first and second combine circuits 74 and 76. The first combine circuit 74 has a first input coupled to the R output of the video signal source 60, a second input coupled to the HSYNC output of the video signal source 60 and an output which provides the R+HSYNC video/synchronization composite signal. The second combine circuit 76 has a first input coupled to the B output of the video signal source 60, a second input coupled to the VSYNC output of the video signal source 60 and an output which provides the B+VSYNC video/synchronization signal. The G signal, on the other hand, passes through the video encoder 72 without manipulation.

The video monitor 58 includes a video decoder 84 coupled to the first, second and third output lines 78, 80 and 82 of the computer system 56 and a display generator 86 coupled to the video decoder 84. Again, it should be noted that the video monitor 58 has been greatly simplified for ease of illustration and that various other types of electronic devices not shown in FIG. 4 are typically incorporated therein. The video decoder 84 is comprised of a first separator circuit 88 having an input coupled to the R+HSYNC video/synchronization composite output line 78 of the computer system 56, a first output line 92 on which the R video signal generated thereby is placed and a second output line 94 on which the HSYNC synchronization signal generated thereby is placed and a second separator circuit 90 having an input coupled to the B+VSYNC output line 80 of the computer system 56, a first output line 96 on which the B video signal generated thereby is placed and a second output line 98 on which the VSYNC synchronization signal generated thereby is placed. Similar to the video encoder 72, the G video signal passes through the video decoder 84 unmodified.

Figure 5:
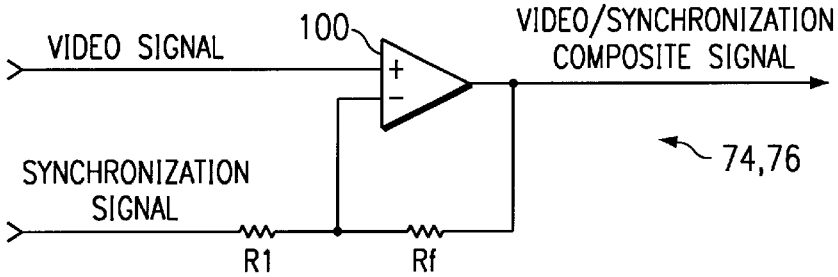
FIG. 5 is a block diagram of a combine circuit of the encoder of FIG. 4.

Referring next to FIG. 5, the combine circuits 74 and 76 will now be described in greater detail. Each combine circuit 74, 76 is comprised of an operational amplifier 100 having a video signal tied to an non-inverting input thereof and a synchronization signal tied to an inverting input thereof. An input resistor $R_i$ is connected between the source of the synchronization signal and the inverting input of the operational amplifier 100 while a feedback resistor $R_f$ is connected between the output of the operational amplifier 100 and the inverting input.

Figure 6:
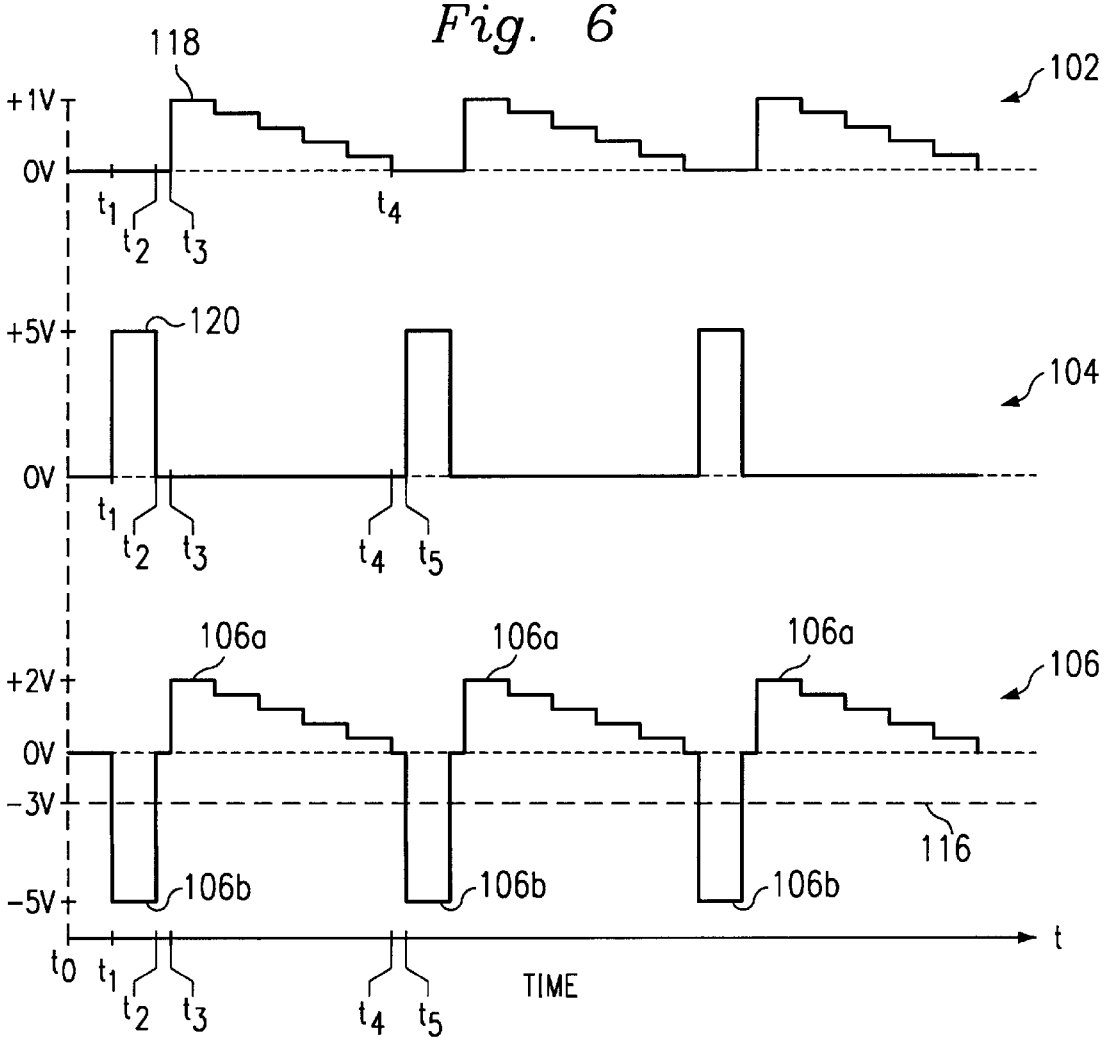
FIG. 6 is a graphical illustration of the combination of a video signal and a positive-going sync pulse by the combine circuit of FIG. 5.

Referring collectively to FIGS. 5 and 6, the operation of the combine circuit 74, 76 to produce a video/synchronization composite signal from a video signal and a positive-going synchronization signal will now be described in greater detail. At $t_0$, both the video signal 102, the synchronization signal 104 and the video/synchronization composite signal 106 are low. At $t_1$, the synchronization signal 104 pulses high while the video signal is in a blanking period. As the synchronization signal 104 is tied to the inverting input of the operational amplifier 100 and the video signal 102 remains low, the video/synchronization composite signal 106 is driven low into an inverted synchronization pulse. At $t_2$, the synchronization pulse ends and the synchronization signal 104 returns to zero. In response, the video/synchronization composite signal 106 also returns to zero. At $t_3$, the blanking period of the video signal 102 ends and the video signal 102 begins to contain video data. As the video signal 102 is tied to the non-inverting input of the operational amplifier 100 while the synchronization signal 104 remains low, the video signal 102 passes through the operational amplifier 100. Thus, the video/synchronization composite signal 106 is driven high to match the video data. At $t_4$, the video signal 102 enters a next blanking period, thereby dropping the video/synchronization composite signal 106 to zero and, at $t_5$, the synchronization signal 106 pulses, thereby driving the video/synchronization composite signal 106 into another inverted synchronization pulse. It should be noted that, while, in FIG. 6, the synchronization signal 104 and the video/synchronization composite signal 106 appear to be of equal magnitude and opposite polarity at $t_1$, the magnitude of the video/synchronization composite signal 106 depends on the values selected for resistors $R_i$ and $R_f$. Specifically, the magnitude of the video/synchronization composite signal 106 shall be equal to $-(R_f/R_i)$ times the synchronization signal 104. Similarly, while the video signal 102 and the video/synchronization composite signal 106 also appear to be of equal magnitude between $t_3$ and $t_4$, the magnitude of the video/synchronization composite signal is equal to $(1+R_f/R_i)$ times the video signal 102. Furthermore, while the magnitude of the video/synchronization signal 106 may be set at selected levels by appropriate selection of $R_f$ and $R_i$, it should be clearly understood that the ratio of the magnitude of video component 106*a* to the video signal 102 will vary in comparison to the ratio of the synchronization component 106*b* to the synchronization signal 104. For example, if $R_f$ and $R_i$, are selected such that data component 106*a* of the video/synchronization composite signal 106 has a gain of 2, the synchronization component 106*b* will have a gain of −1. While various magnitudes for the video and synchronization components 106*a* and 106*b* are acceptable for the uses contemplated herein, suitable magnitudes for peak video and synchronization signals 102 and 104 are 1 volt and 5 volts, respectively, while suitable magnitudes for peak video component and synchronization components 106*a* and 106*b* are 2 and −5 volts, respectively.

Figure 7:
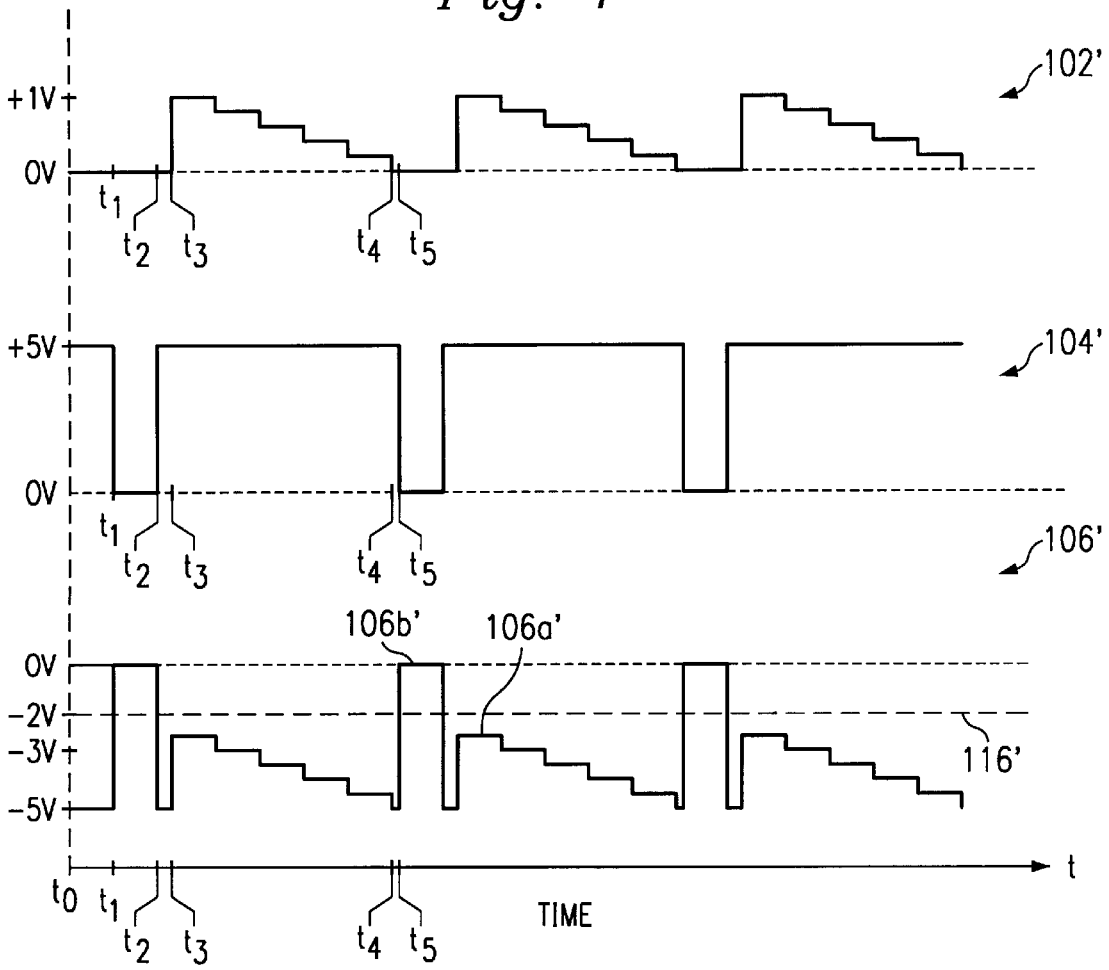
FIG. 7 is a graphical illustration of the combination of a video signal and a negative-going sync pulse by the combine circuit of FIG. 5.

In FIG. 6, the video/synchronization composite signal 106 produced in response to a positive-going synchronization signal 104 is shown. It is, however, the video/synchronization composite signal produced by the video encoder 72 in response to a negative-going synchronization pulse that is of particular interest. Turning now to FIGS. 5 and 7, the operation of the combine circuit 74, 76 to produce a video/synchronization composite signal 106' from the video signal and a negative-going synchronization signal 104' will now be described in greater detail. Unlike a positive-going synchronization signal characterized by a normally low state and periodic positive-going voltage pulses into a high state, a negative-going synchronization signal is characterized by a normally high state and periodic downward-going pulses into a low state. As before, suitable high and low states for the synchronization pulse 104' are +5 volts and zero and the peak level for the video signal 102 is +1 volt.

At $t_0$, the video signal 102 is low, the synchronization signal 104' is high and the video/synchronization composite signal 106' is the inversion of the synchronization signal 104', i.e., −5 volts. At $t_1$, the synchronization signal 104' pulses low to zero while the video signal 102' is in a blanking period. As the synchronization signal 104' is tied to the inverting input of the operational amplifier 100 and the video signal 102 remains low, the video/synchronization composite signal 106' is driven to zero, thereby matching the synchronization signal 104'. At $t_2$, the synchronization pulse ends and the synchronization signal 104' returns to its normal high state and the video/synchronization composite pulse 106' returns to its normal low state (−5 volts) produced by inverting the synchronization pulse 104'. At $t_3$, the blanking period of the video signal 102 ends and the video signal 102 begins to contain video data. As the video signal 102 is tied to the non-inverting input of the operational amplifier 100 while the synchronization signal 104 remains high, the video signal 102 is added to the inversion of the synchronization signal 104'. thereby producing the video/synchronization composite signal 106' illustrated in FIG. 7. As may be seen, between $t_3$ and $t_4$, the net effect of combining the video and synchronization signals 102 and 104' result in a downward shift of the video signal 102 (after a gain of 2) by an amount equal to the magnitude of the normally high (+5 volts) state of the synchronization signal 104'. At $t_4$, the video signal 10' enters a next blanking period, thereby dropping the video/synchronization composite signal 106' to zero and, at $t_5$, the synchronization signal 106' again pulses to drive the video/synchronization composite signal 106' to zero. As may now be seen, while both the video and synchronization components 106*a'* and 106*b'* have been changed, relative to the original signals 102, 104', by the encoder 72, the identity of both the video signal 102 and the synchronization signal 104' have been maintained in the video/synchronization composite signal 106'. Thus, a properly configured video decoder can readily separate the two signals Referring next to FIG. 8, the separator circuits 88, 90 for removing the video and synchronization information encoded into the video/synchronization composite signal 106 or 106' will now be described in greater detail. As may now be seen, each separator circuit 88, 90 is comprised of an operational amplifier 108 and a comparator 110. The operational amplifier 108 has the video/synchronization composite signal tied to the non-inverting input and the inverting input tied to its output. The comparator 110 has a first input tied to the output of the operational amplifier 108 and a second input tied to a reference voltage signal. The outputs of the operational amplifier 108 and the comparator 110 are tied to a common node 114 (the first output of the separator circuit 88, 90) with balancing resistors $R_a$ and $R_b$ placed between the output of the operational amplifier 108 and the output of the comparator 110, respectively, and the node 114. The output of the comparator 110 is also tied to the second output of the separator circuit 88, 90.

Figure 8:
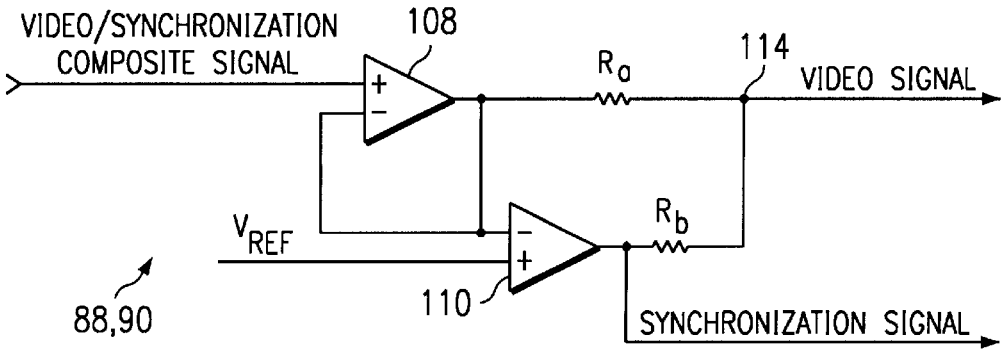
FIG. 8 is a block diagram of a separator circuit of the decoder of FIG. 4.

Referring next to FIGS. 6 and 8, the operation of the separator circuits 88, 90 to separate the video signal 102 and the synchronization signal 104 from the video/synchronization composite signal 106 when the synchronization signal 104 is positive-going will now be described in greater detail. As the video/synchronization composite signal is tied to the non-inverting input of the operational amplifier and the output of the operational amplifier 108 is tied back to the inverting input thereof, the operational amplifier 108 passes the video/synchronization composite signal. Thus, the video/synchronization composite signal and a reference voltage signal 116 are provided as first and second inputs to the comparator 110. As shown in FIG. 6, the reference voltage 116 is preferably selected to be a negative voltage having a magnitude approximately equal to the difference between the peak value 118 of the video signal 102 and the peak value 120 of the synchronization signal 104. Thus, for the provided example, the reference voltage signal 116 should be set to −3 volts. It should be clearly understood, however, that the magnitude of the reference voltage signal 116 may have any value between 0 and the preferred value.

As the positive and negative inputs to the comparator 110 are respectively tied to the reference voltage signal 116 and the video/synchronization composite signal 106, the output of the comparator 110 goes high whenever the video/synchronization composite signal 106 drops below the reference voltage signal 116. Thus, the output of the comparator 110 matches the original synchronization signal 104 and is, therefore, provided as the second output of the separator circuit 88, 90. Furthermore, when the output of the comparator 110 is combined with the video/synchronization composite signal 106, the output of the comparator 110 cancels the synchronization component of the video/synchronization signal 106, thereby restoring the original video signal at node 114 which is, therefore, provided as the first output of the separator circuit 88, 90. Of course, any gain in the video signal is removed by proper selection of the $R_a$ and $R_b$ resistors.

An identical result is achieved when the video/synchronization composite signal 106' is input the separator circuit 88, 90. As before, the output of the comparator 110 goes high whenever the video/synchronization signal 106' drops below the negative reference voltage 116. Here, however, the output of the comparator is driven high for the video component of the video/synchronization signal 116' but remains low for the synchronization component of the video/synchronization composite signal 106'. Thus, when the video/synchronization composite signal 106' and the output of the comparator 110 are combined, the synchronization component is unchanged while the video component is shifted back to its original magnitude, thereby restoring the video signal 102. Furthermore, as the output of the comparator 110 is a normally high signal which is driven low at the synchronization pulses, the output of the comparator 110 is the same as the original synchronization signal 104'.

Although illustrative embodiments of the invention have been shown and described, other modifications, changes, and substitutions are intended in the foregoing disclosure. For example, the invention is equally suitable for use in a wide variety of video transmission and display systems other than those specifically disclosed herein. Accordingly, it is appropriate that the appended claims be construed broadly and in a manner consistent with the scope of the invention.

What is claimed is:

1. A video display system, comprising:

a video signal generator having first, second and third outputs, said video signal generator combining a first video signal and a first synchronization signal having a polarity to produce a first, polarity insensitive, video/synchronization composite signal at said first output, combining a second video signal and a second synchronization signal having said polarity to produce a second, polarity insensitive, video/synchronization composite signal at said second output and producing a third video signal at said third output; and a video monitor having first, second and third inputs respectively coupled to said first, second and third outputs of said video signal generator, said video monitor generating an image from said first, polarity insensitive, video/synchronization composite signal, said second, polarity insensitive, video/synchronization composite signal and said third video signal by separating said first video signal and said first synchronization signal from said first, polarity insensitive, video/synchronization composite signal and separating said second video signal and said second synchronization signal from said second, polarity insensitive, video/synchronization composite signal;

said first and second polarity insensitive video/synchronization composite signals being separable into said first video signal, said first synchronization signal said second video signal and said second synchronization signal regardless of whether said polarity of said first and second synchronization signals used to produce said first and second polarity insensitive video/synchronization signals is positive or negative.

2. A video display system according to claim 1 wherein said video signal generator further comprises a video source having first, second, third, fourth and fifth outputs, said video source providing said first video signal on said first output, said first synchronization signal on said second output, said second video signal on said third output, said second synchronization signal on said fourth output and said third video signal on said fifth output.

3. A video display system according to claim 2 wherein said video signal generator further comprises a first combine circuit having first and second inputs respectively coupled to said first and second outputs of said video source and an output coupled to said first output of said video signal generator, said first combine circuit generating said first, polarity insensitive, video/synchronization composite signal from said first video signal and said first synchronization signal.

4. A video display system, comprising:

a video signal generator having first, second and third outputs, said video signal generator providing a first video/synchronization composite signal at said first output, a second video/synchronization composite signal at said second output and a video signal at said third output; and a video monitor having first, second and third inputs respectively coupled to said first, second and third outputs of said video signal generator, said video monitor generating an image from said first video/synchronization composite signal, said second video/synchronization composite signal and said video signal;

said video signal generator further comprising;

a video source having first, second, third, fourth and fifth outputs, said video source providing a first video signal on said first output, a first synchronization signal on said second output, a second video signal on said third output, a second synchronization signal on said fourth output and a third video signal on said fifth output, a first combine circuit having first and second inputs respectively coupled to said first and second outputs of said video source and an output coupled to said first output of said video signal generator, said first combine circuit generating said first video/synchronization composite signal from said first video signal and said first synchronization signal;

said first combine circuit further comprising:

an operation amplifier having an amplifying input, an inverting input and an output, said amplifying input coupled to said first output of said video source to receive said first video signal therefrom and said inverting input coupled to said second output of said video source to receive said first synchronization signal therefrom;

said operational amplifier providing said first video/synchronization composite signal at said output thereof.

5. A video display system according to claim 3 wherein said video signal generator further comprises a second combine circuit having first and second inputs respectively coupled to said third and fourth outputs of said video source and an output coupled to said second output of said video signal generator, said second, polarity insensitive combine circuit generating said second video/synchronization composite signal from said second video signal and said second composite signal.

6. A video display system comprising:

a video signal generator having first, second and third outputs said video signal generator providing a first video/synchronization composite signal at said first output, a second video/synchronization composite signal at said second output and a video signal at said third output; and a video monitor having first, second and third inputs respectively coupled to said first, second and third outputs of said video signal generator, said video monitor generating an image from said first video/synchronization composite signal, said second video/synchronization composite signal and said video signal;

said video signal generator further comprising:

a video source having first, second, third, fourth and fifth outputs, said video source providing a first video signal on said first output, a first synchronization signal on said second output, a second video signal on said third output, a second synchronization signal on said fourth output and a third video signal on said fifth output;

a first combine circuit having first and second inputs respectively coupled to said first and second outputs of said video source and an output coupled to said first output of said video signal generator, said first combine circuit generating said first video/synchronization composite signal from said first video signal and said first composite signal;

a second combine circuit having first and second inputs respectively coupled to said third and fourth outputs of said video source and an output coupled to said second output of said video signal generator, said second combine circuit generating said second video/synchronization composite signal from said second video signal and said second composite signal;

said first combine circuit further comprising a first operational amplifier having an amplifying input, an inverting input and an output, said amplifying input coupled to said first output of said video source to receive said first video signal therefrom and said inverting input coupled to said second output of said video source to receive said first synchronization signal therefrom, said first operational amplifier providing said first video/synchronization composite signal at said output thereof, said second combine circuit further comprising a second operational amplifier having an amplifying input, an inverting input and an output, said amplifying input coupled to said third output of said video source to receive said second video signal therefrom and said inverting input coupled to said fourth output of said video source to receive said second synchronization signal therefrom, said second operational amplifier providing said second video/synchronization composite signal at said output thereof.

7. A video display system according to claim 2 wherein said video monitor further comprises a first separator circuit having an input coupled to said first input of said video monitor and first and second outputs, said first separator circuit separating said first video signal and said first synchronization signal from said first, polarity insensitive, video/synchronization composite signal and respectively providing said first video signal and said first synchronization signal on said first and second outputs.

8. A video display system, comprising:

a video signal generator having first, second and third outputs, said video signal generator providing a first video/synchronization composite signal at said first output, a second video/synchronization composite signal at said second output and a video signal at said third output; and a video monitor having first, second and third inputs respectively coupled to said first, second and third outputs of said video signal generator, said video monitor generating an image from said first video/synchronization composite signal, said second video/synchronization composite signal and said video signal;

said video signal generator further comprising a video source having first, second third, fourth and fifth outputs, said video source providing a first video signal on said first output, a first synchronization signal on said second output, a second video signal on said third output, a second synchronization signal on said fourth output and a third video signal on said fifth output;

said video monitor further comprising a first separator circuit having an input coupled to said first input of said video monitor and first and second outputs, said first separator circuit separating said first video signal and said first synchronization signal from said first video/synchronization composite signal and respectively providing said first video signal and said first synchronization signal on said first and second outputs said first separator circuit further comprising:

an operational amplifier having an amplifying input, an inverting input and an output, said amplifying input coupled to said first output of said video signal generator to receive said first video/synchronization composite signal and said output of said operational amplifier coupled to said inverting input of said operational amplifier and to said first output of said first separator circuit;

a comparator having first and second inputs and an output, said first input of said comparator coupled to said output of said operational amplifier, said second input of said comparator coupled to a voltage reference signal and said output of said comparator coupled to said output of said first separator circuit and to said second output of said first separator circuit.

9. A video display system according to claim 8 wherein said first reference voltage is a negative voltage signal having a first magnitude selected to be approximately the difference between a peak value of said first video signal and a peak value of said first synchronization signal.

10. A video display system according to claim 7 wherein said video monitor further comprises a second separator circuit having an input coupled to said second input of said video monitor and first and second outputs, said second separator circuit separating said second video signal and said second synchronization signal from said second, polarity insensitive, video/synchronization composite signal and respectively providing said second video signal and said second synchronization signal on said first and second outputs.

11. A video display system, comprising:

a video signal generator having first, second and third outputs, said video signal generator providing a first video/synchronization composite signal at said first output, a second video/synchronization composite signal at said second output and a video signal at said third output;

said video signal generator further comprising:

a video source having first, second, third, fourth and fifth outputs, said video source providing a first video signal on said first output, a first synchronization signal on said second output, a second video signal on said third output, a second synchronization signal on said fourth output and a third video signal on said fifth output;

a video monitor having first, second and third inputs respectively coupled to said first, second and third outputs of said video signal generator, said video monitor generating an image from said first video/synchronization composite signal, said second video/synchronization composite signal and said video signal;

said video monitor further comprising:

a first separator circuit having an input coupled to said first input of said video monitor and first and second outputs, said first separator circuit separating said first video signal and said first synchronization signal from said first video/synchronization composite signal and respectively providing said first video signal and said first synchronization signal on said first and second outputs;

a second separator circuit having an input coupled to said second input of said video monitor and first and second outputs, said second separator circuit separating said second video signal and said second synchronization signal from said second video/synchronization composite signal and respectively providing said second video signal and said second synchronization signal on said first and second outputs;

said first separator circuit further comprises an operational amplifier having an amplifying input, an inverting input and an output, said amplifying input coupled to said first output of said video signal generator to receive said first video/synchronization composite signal and said output of said operational amplifier coupled to said inverting input of said operational amplifier and to said first output of said first separator circuit, a comparator having first and second inputs and an output, said first input of said comparator coupled to said output of said operational amplifier, said second input of said comparator coupled to a first voltage reference signal and said output of said comparator coupled to said first output of said first separator circuit and said second output of said first separator circuit;

said second separator circuit further comprises an operational amplifier having an amplifying input, an inverting input and an output, said amplifying input coupled to said second output of said video signal generator to receive said second video/synchronization composite signal and said output of said operational amplifier coupled to said inverting input of said operational amplifier and to said first output of said second separator circuit, a comparator having first and second inputs and an output, said first input of said comparator coupled to said output of said operational amplifier, said second input of said comparator coupled to a second voltage reference signal and said output of said comparator coupled to said first output of said second separator circuit and to said second output of said second separator circuit.

12. A video display system according to claim 10 wherein said first reference voltage is a negative voltage signal having a first magnitude selected to be approximately the difference between a peak value of said first video signal and a peak value of said first synchronization signal and said second reference voltage is a negative voltage signal having a second magnitude selected to be approximately the difference between a peak value of said second video signal and a peak value of said second synchronization signal.

13. For a video display system which includes a video signal source which provides first, second and third video signals, a first synchronization signal and a second synchronization signal, said first and second synchronization signals having a polarity, a polarity insensitive video encoder comprising:

a first combine circuit having first and second inputs and an output, said first input connected to receive said first video signal from said video signal source, said second input connected to receive said first synchronization signal from said video signal source, said first combine circuit generating a first, polarity insensitive, video/synchronization composite signal from said first video signal and said first synchronization signal and providing said first, polarity insensitive, video/synchronization composite signal at said output; and a second combine circuit having first and second inputs and an output, said first input connected to receive said second video signal from said video signal source, said second input connected to receive said second synchronization signal from said video signal source, said second combine circuit generating a second, polarity insensitive, video/synchronization composite signal from said second video signal and said second synchronization signal and providing said second, polarity insensitive, video/synchronization composite signal at said output.

14. A video encoder according to claim 13 wherein said first, second and third video signals are R, B and G video signals, respectively and said first and second synchronization signals are HSYNC and VSYNC synchronization signals, respectively.

15. For a video display system which includes a video signal source which provides R, B and G video signals an HSYNC synchronization signal and a VSYNC synchronization signal a video encoder comprising:

a first combine circuit having first and second inputs and an output, said first input connected to receive said R video signal from said video signal source, said second input connected to receive said HSYNC synchronization signal from said video signal source said first combine circuit generating a first video/synchronization composite signal from said R video signal and said HSYNC synchronization signal and providing said first video/synchronization composite signal at said output;

a second combine circuit having first and second inputs and an output, said first input connected to receive said B video signal from said video signal source, said second input connected to receive said VSYNC synchronization signal from said video signal source said second combine circuit generating a second video/synchronization composite signal from said B video signal and said VSYNC synchronization signal and providing said second video/synchronization composite signal at said output;

said first combine circuit further comprising a first operational amplifier having an amplifying input, an inverting input and an output, said amplifying input connected to receive said R video signal from said video signal source and said inverting input connected to receive said HSYNC synchronization signal from said video signal source, said first operational amplifier inverting said HSYNC synchronization signal and adding said inverted HSYNC synchronization signal to said R video signal to generate said first video/synchronization composite signal; and said second combine circuit further comprising a second operational amplifier having an amplifying input, an inverting input and an output, said amplifying input connected to receive said B video signal from said video signal source and said inverting input connected to receive said VSYNC synchronization signal from said video signal source, said second operational amplifier inverting said VSYNC synchronization signal and adding said inverted VSYNC synchronization signal to said B video signal to generate said second video/synchronization composite signal.

16. A method for encoding video and synchronization data into a polarity insensitive video/synchronization composite signal, comprising the steps of:

receiving a video signal and a synchronization signal from a video source, said synchronization signal having a polarity;

inverting said synchronization signal;

producing a polarity insensitive video/synchronization composite signal by adding said inverted synchronization signal to said video signal; and transmitting said produced polarity insensitive video/synchronization composite signal to a video monitor;

wherein said polarity of said synchronization signal may be determined when decoding said polarity insensitive video/synchronization composite signal.

17. For a video monitor which receives a first, polarity insensitive, video/synchronization composite signal, a second, polarity insensitive, video/synchronization composite signal and a third video signal from a encoded video signal source, a polarity insensitive video decoder comprising:

a first separator circuit having an input and first and second outputs, said input connected to receive a first, polarity insensitive, video/synchronization composite signal from said encoded video signal source, said first separator circuit generating a first video signal and a first synchronization signal having a polarity from said first, polarity insensitive, video/synchronization composite signal, providing said first video signal at said first output and providing said first synchronization signal having said polarity at said second output; and a second separator circuit having an input and first and second outputs, said input connected to receive a second, polarity insensitive, video/synchronization composite signal from said encoded video signal source, said second separator circuit generating a second video signal and a second synchronization signal having said polarity from said second video/synchronization composite signal, providing said second video signal at said first output and providing said second synchronization signal having said polarity at said second output.

18. For a video monitor which receives a first video/synchronization composite signal, a second video/synchronization composite signal and a third video signal from a encoded video signal source, a video decoder comprising:

a first separator circuit having an input and first and second outputs, said input connected to receive a first video/synchronization composite signal from said encoded video signal source, said first separator circuit generating a first video signal and a first synchronization signal from said first video/synchronization composite signal, providing said first video signal at said first out-out and providing said first synchronization signal at said second output;

a second separator circuit having an input and first and second outputs, said input connected to receive a second video/synchronization composite signal from said encoded video signal source, said second separator circuit generating a second video signal and a second synchronization signal from said second video/synchronization composite signal, providing said second video signal at said first output and providing said second synchronization signal at said second output;

said first separator circuit further comprising an operational amplifier having an amplifying input, an inverting input and an output, a comparator having first and second inputs and an output;

said amplifying input of said operational amplifier connected to receive said first video/synchronization composite signal from said encoded video source and said output of said operational amplifier coupled to said inverting input and said output of said first separator circuit;

said first input of said comparator coupled to said output of said operational amplifier, said second input of said comparator coupled to a first voltage reference signal and said output of said comparator coupled to said first output of said first separator circuit and to said second output of said first separator circuit;

said operational amplifier passing said first video/synchronization composite signal to said output of said first separator circuit;

said comparator generating said first synchronization signal for combination with said first video/synchronization composite signal at said output of said first separator circuit to produce said first video signal and for output at said second output of said first separator circuit.

19. A video decoder according to claim 18 wherein:

said second separator circuit further comprises an operational amplifier having an amplifying input, an inverting input and an output;

said amplifying input of said operational amplifier connected to receive said second video/synchronization composite signal from said encoded video source and said output of said operational amplifier coupled to said inverting input and said output of said second separator circuit;

said first input of said comparator coupled to said output of said operational amplifier, said second input of said comparator coupled to a second voltage reference signal and said output of said comparator coupled to said first output of said second separator circuit and to said second output of said second separator circuit;

said operational amplifier passing said second video/synchronization composite signal to said output of said second separator circuit;

said comparator generating said second synchronization signal for combination with said second video/synchronization composite signal at said output of said second separator circuit to produce said second video signal and for output at said second output of said second separator circuit.

20. A video decoder according to claim 17 wherein said first and second video signals are R and B video signals, respectively, and said first and second synchronization signals are HSYNC and VSYNC synchronization signals, respectively.

21. For a video monitor which receives a first video/synchronization composite signal, a second video/synchronization composite signal and a third video signal from a encoded video signal source, a video decoder comprising:

a first separator circuit having an input and first and second outputs, said input connected to receive a first video/synchronization composite signal from said encoded video signal source, said first separator circuit generating an R video signal and an HSYNC synchronization signal from said first video/synchronization composite signal, providing said R video signal at said first output and providing said HSYNC synchronization signal at said second output;

a second separator circuit having an input and first and second outputs, said input connected to receive a second video/synchronization composite signal from said encoded video signal source, said second separator circuit generating video signal and a VSYNC synchronization signal from said second video/synchronization composite signal, providing said B video signal at said first output and providing said VSYNC synchronization signal at said second output;

said first separator circuit further comprising an operational amplifier having an amplifying input, an inverting input and an output, a comparator having first and second inputs and an output;

said amplifying input of said operational amplifier connected to receive said first video/synchronization composite signal from said encoded video source and said output of said operational amplifier coupled to said inverting input and said output of said first separator circuit;

said first input of said comparator coupled to said output of said operational amplifier, said second input of said comparator coupled to a first voltage reference signal and said output of said comparator coupled to said first output of said first separator circuit and to said second output of said first separator circuit;

said operational amplifier passing said first video/synchronization composite signal to said output of said first separator circuit;

said comparator generating a HSYNC signal for combination with said first video/synchronization composite signal at said output of said first separator circuit to produce said R video signal and for output at said second output of said first separator circuit.

22. A video decoder according to claim 21 wherein:

said second separator circuit further comprises an operational amplifier having an amplifying input, an inverting input and an output;

said amplifying input of said operational amplifier connected to receive said second video/synchronization composite signal from said encoded video source and said output of said operational amplifier coupled to said inverting input and said output of said second separator circuit;

said first input of said comparator coupled to said output of said operational amplifier, said second input of said comparator coupled to a second voltage reference signal and said output of said comparator coupled to said first output of said second separator circuit and to said second output of said second separator circuit;

said operational amplifier passing said second video/synchronization composite signal to said output of said second separator circuit;

said comparator generating a VSYNC signal for combination with said second video/synchronization composite signal at said output of said second separator circuit to produce said B video signal and for output at said second output of said second separator circuit.

23. A method for decoding a polarity insensitive video/synchronization composite signal into a video signal and a synchronization signal, said synchronization signal having a polarity comprising the steps of:

receiving a polarity insensitive video/synchronization composite signal from an encoded video source;

generating a synchronization signal having said polarity from said polarity insensitive video/synchronization composite signal and a reference voltage signal;

combining said synchronization signal having said polarity and said polarity insensitive video/synchronization composite signal to produce a video signal; and generating an image using said video signal and said synchronization signal having said polarity.

24. A video encoder according to claim 13 wherein said first combine circuit produces said first, polarity insensitive, video/synchronization composite signal by combining said first video signal with an inversion of said first synchronization signal and wherein said second combine circuit produces said second, polarity insensitive, video/synchronization composite signal by combining said second video signal with an inversion of said second synchronization signal.

25. For a video display system which includes a video signal source which provides a video signal and a synchronization signal having a polarity, a polarity insensitive video encoder comprising:

a combine circuit having first and second inputs and an output, said first input connected to receive said video signal from said video signal source, said second input connected to receive said synchronization signal having said polarity from said video signal source, said first combine circuit generating a polarity insensitive video/synchronization composite signal from said video signal and said synchronization signal and providing said polarity insensitive video/synchronization composite signal at said output, wherein said polarity of said synchronization signal may be determined when decoding said polarity insensitive video/synchronization composite signal.

26. A video encoder according to claim 25 wherein said combine circuit produces said polarity insensitive video/synchronization composite signal by combining said video signal with an inversion of said synchronization signal.

27. For a video display system which includes a video signal source which provides first, second and third video signals, a first synchronization signal and a second synchronization signal, a video encoder comprising:

a first combine circuit having first and second inputs and an output, said first input connected to receive said first video signal from said video signal source, said second input connected to receive said first synchronization signal from said video signal source, said first combine circuit generating a first video/synchronization composite signal from said first video signal and said first synchronization signal and providing said first video/synchronization composite signal at said output;

a second combine circuit having first and second inputs and an output, said first input connected to receive said second video signal from said video signal source, said second input connected to receive said second synchronization signal from said video signal source, said second combine circuit generating a second video/synchronization composite signal from said second video signal and said second synchronization signal and providing said second video/synchronization composite signal at said output;

said first combine circuit further comprising a first operational amplifier having an amplifying input, an inverting input and an output, said amplifying input connected to receive said first video signal from said video signal source and said inverting input connected to receive said first synchronization signal from said video signal source, said first operational amplifier inverting said first synchronization signal and adding said inverted first synchronization signal to said first video signal to generate said first video/synchronization composite signal; and said second combine circuit further comprising a second operational amplifier having an amplifying input, an inverting input and an output, said amplifying input connected to receive said second video signal from said video signal source and said inverting input connected to receive said second synchronization signal from said video signal source, said second operational amplifier inverting said second synchronization signal and adding said inverted second synchronization signal to said second video signal to generate said second video/synchronization composite signal.

28. A video decoder according to claim 17 wherein said first separator circuit generates said first synchronization signal having said polarity from said first, polarity insensitive, video/synchronization composite signal by comparing the first, polarity insensitive, video/synchronization composite signal to a negative reference voltage signal having a magnitude approximately equal to the difference between a peak pulse level for said synchronization signal and a peak pulse level for said video signal and generates said first video signal by combining said first, polarity insensitive, video/synchronization composite signal and said generated first synchronization signal having said polarity and wherein said second separator circuit generates said second synchronization signal having said polarity from said second, polarity insensitive, video/synchronization composite signal by comparing said second, polarity insensitive, video/synchronization composite signal to said negative reference voltage signal having said magnitude and said second video signal by combining said second, polarity insensitive, video/synchronization composite signal and said generated second synchronization signal having said polarity.

29. For a video monitor which receives a polarity insensitive video/synchronization composite signal produced using a synchronization signal having a polarity from an encoded video signal source, a polarity insensitive video decoder comprising:

a separator circuit having an input and first and second outputs, said input connected to receive a polarity insensitive, video/synchronization composite signal from said encoded video signal source, said first separator circuit generating a video signal and said synchronization signal having said polarity from said polarity insensitive video/synchronization composite signal, providing said video signal at said first output and providing said synchronization signal having said polarity at said second output.

30. For a video monitor which receives a polarity insensitive video/synchronization composite signal from an encoded video signal source, a polarity insensitive video decoder comprising:

a separator circuit having an input and first and second outputs, said input connected to receive a polarity insensitive, video/synchronization composite signal from said encoded video signal source, said first separator circuit generating a video signal and a first synchronization signal having a polarity from said polarity insensitive video/synchronization composite signal, providing said video signal at said first output and providing said synchronization signal having said polarity at said second output;

said first separator circuit further comprising:

an operational amplifier having an amplifying input, an inverting input and an output, and a comparator having first and second inputs and an output;

said amplifying input of said operational amplifier connected to receive said video/synchronization composite signal from said encoded video source and said output of said operational amplifier coupled to said inverting input and said output of said first separator circuit;

said first input of said comparator coupled to said output of said operational amplifier, said second input of said comparator coupled to a first voltage reference signal and said output of said comparator coupled to said first output of said first separator circuit and to said second output of said first separator circuit;

said operational amplifier passing said video/synchronization composite signal to said output of said first separator circuit;

said comparator generating said synchronization signal for combination with said video/synchronization composite signal at said output of said first separator circuit to produce said first video signal and for output at said second output of said first separator circuit.

31. A video decoder according to claim 30 wherein said first separator circuit generates said synchronization signal having said polarity from said polarity insensitive, video/synchronization composite signal by comparing said polarity insensitive video/synchronization composite signal to a negative reference voltage signal having a magnitude approximately equal to the difference between a peak pulse level for said synchronization signal and a peak pulse level for said video signal and generates said video signal by combining said polarity insensitive video/synchronization composite signal and said generated synchronization signal having said polarity.

32. A method according to claim 23 and further comprising the step of selecting a reference voltage signal to be a negative voltage signal having a magnitude approximately equal to the difference between a peak value of said video signal and a peak value of said synchronization signal.

33. A method according to claim 32 wherein the step of generating a synchronization signal from said polarity insensitive video/synchronization composite signal and a reference voltage signal further comprises the step of combining said polarity insensitive video/synchronization composite signal and said negative voltage signal having said magnitude.

* * * * *